US005365157A

United States Patent [19]

Geller et al.

[11] Patent Number: 5,365,157

[45] Date of Patent: Nov. 15, 1994

[54] VOLTAGE REGULATOR EMPLOYING A TRIAC TO DELIVER VOLTAGE TO A LOAD

[75] Inventors: Alexander Geller, Brooklyn; Steven Abdelqader, Theills, both of N.Y.

[73] Assignee: Coltene/Whaledent, Inc., Mahwah, N.J.

[21] Appl. No.: 178,779

[22] Filed: Jan. 7, 1994

[51] Int. Cl.[5] ..... G05F 1/10; G05F 1/40; G05F 1/455

[52] U.S. Cl. ..... 323/237; 323/319

[58] Field of Search ..... 323/237, 239, 241, 902, 323/320, 322, 323, 324, 319

[56] References Cited

U.S. PATENT DOCUMENTS

| | | | |
|---|---|---|---|
| Re. 33,184 | 3/1990 | Westfall et al. | 323/243 |
| 4,355,242 | 10/1982 | Lezan et al. | 307/252 N |
| 4,465,966 | 8/1984 | Long et al. | 323/326 |
| 4,518,867 | 5/1985 | Lamboley | 323/239 X |
| 4,528,494 | 7/1985 | Bloomer | 323/237 |
| 4,565,958 | 1/1986 | Cooper | 323/319 |
| 4,689,548 | 8/1987 | Mechlenburg | 323/243 |
| 4,766,363 | 8/1988 | Rutter et al. | 323/243 |

*Primary Examiner*—Kristine L. Peckman

*Assistant Examiner*—E. To

*Attorney, Agent, or Firm*—Helfgott & Karas

[57] ABSTRACT

An alternating current voltage regulator providing a stable RMS output voltage across a load. The voltage applied to the load being determined by controlling the firing angle of a triac, which is controlled by the pulse width of a timing signal generated in a timer circuit. The pulse width of the timing signal is controlled by an error signal. The error signal is based upon the actual triac output voltage as compared with a comparison signal. The voltage delivered to the load is compared with a RMS reference voltage to produce the comparison signal. The potential difference between the output voltage and the comparison signal is constantly monitored to produce the error signal. The error signal is thus constantly applied to vary the pulse width of the timing signal and thus vary the firing angle of the triac in accordance with the deviation of the actual output voltage from the stable RMS reference voltage. By constantly varying the firing angle of the triac with regards to deviations from the stable RMS reference voltage, the triac output is constantly adjusted to produce an output voltage substantially equal to the RMS reference voltage.

8 Claims, 3 Drawing Sheets

0.75msec.
8.33 msec.
12V
t TP3

8.33msec
0.75msec.
12V
t TP4

>3msec.
12V
t TP5

>3msec.
≈100msec.
24V
t TP6

12V
t TP7

8.33msec
≈100msec
t TP8

+I
0
-I
t
FIRING ANGLE
CONDUCTING ANGLE

VOLTAGE REGULATOR EMPLOYING A TRIAC TO DELIVER VOLTAGE TO A LOAD

BACKGROUND OF THE INVENTION

1. Field of the Invention

The present invention relates generally to voltage regulators and, more particularly, to voltage regulators employing an error signal to change the firing angle of a triac delivering voltage to a load.

2. Description of the Prior Art

The triac is a bi-directional semiconductor device which must be "gated" into conduction upon the simultaneous application of a voltage between its two main terminals and a gating signal applied to a gate electrode. The triac begins conducting when a current of sufficient strength is applied to its gate electrode and remains conducting independently of the gate current, from the moment when, and as long as, a current of strength greater than a given threshold flows therethrough between its main electrodes. Removing the voltage from across the main electrodes, as for example when the source voltage crosses the zero axis, normally renders the triac non-conductive.

It is known to use a triac voltage when regulating voltage in an alternating current voltage source. For example, U.S. Pat. No. 4,355,242 issued on Oct. 19, 1982, uses a voltage regulating or control system employing a triac to control the power supplied to a load from an alternating current voltage source. The system utilizes an oscillator to provide pulse train firing of the triac.

U.S. Pat. No 4,766,363 issued Aug. 23, 1988 supplies power from an A.C. source to a load under the control of a power switching triac in response to signals from a feedback loop.

Other examples of alternating current voltage regulators use sawtooth generators tied to the input voltage source. Based on the output voltage delivered to the load, an error signal is produced and used to control the sawtooth waveform.

The above-mentioned devices, however, are unable to maintain a stable RMS output voltage across the load when utilizing an unregulated A.C. input voltage. These devices use a pulse train or feedback signal to control voltage to the load or control a sawtooth waveform to produce a regulated output voltage.

It is, therefore, needed to produce an alternating current voltage regulator which provides improvements over the presently known devices for regulating an input A.C. voltage to deliver a stable RMS output voltage to a load.

SUMMARY OF THE INVENTION

It is, therefore, an object of the present invention to produce an alternating current voltage regulator which is able to control the firing angle of a triac supplying voltage to a load.

It is another object of the present invention to produce an alternating current voltage regulator in which a timing signal, generated by a timer circuit, to change the firing angle of the triac, has its pulse width varied based upon an error signal indicative of the potential difference between the triac output and a comparator output.

It is a further object of the present invention to produce an alternating current voltage regulator which provides a stable RMS voltage across a load which varies no more than plus or minus 2 percent for an input voltage which may vary plus or minus 15 percent.

It is an even further object of the present invention to provide an alternating current voltage regulator including a very low current rated switch which is able to control the production of the high current output of the triac.

The voltage regulator of the present invention receives an A.C. voltage from a power source and detects the zero crossings of this A.C. voltage. A zero crossing signal is produced and delivered to a timer circuit which produces a timing signal. The timing signal is then used to fire a triac which delivers an output voltage to the load. The output voltage delivered to the load is sensed and an error signal is produced based upon a potential difference between the output voltage and a voltage produced by a comparator circuit. The comparator circuit compares the output voltage with an RMS reference voltage. The error signal is fed back to the timer circuit and acts to control the pulse width of the timing signal to change the firing angle of the triac based upon deviations of the output voltage from the RMS reference voltage. The output voltage is thus held substantially equal to the RMS reference voltage by controlling the pulse width of the timer signal.

The aforementioned objects, features and advantages of the invention will, in part, become obvious from the following more detailed description of the invention, when taken in conjunction with the accompanying drawings which form an integral part thereof.

DETAILED DESCRIPTION OF THE PREFERRED EMBODIMENT

Figure 1:
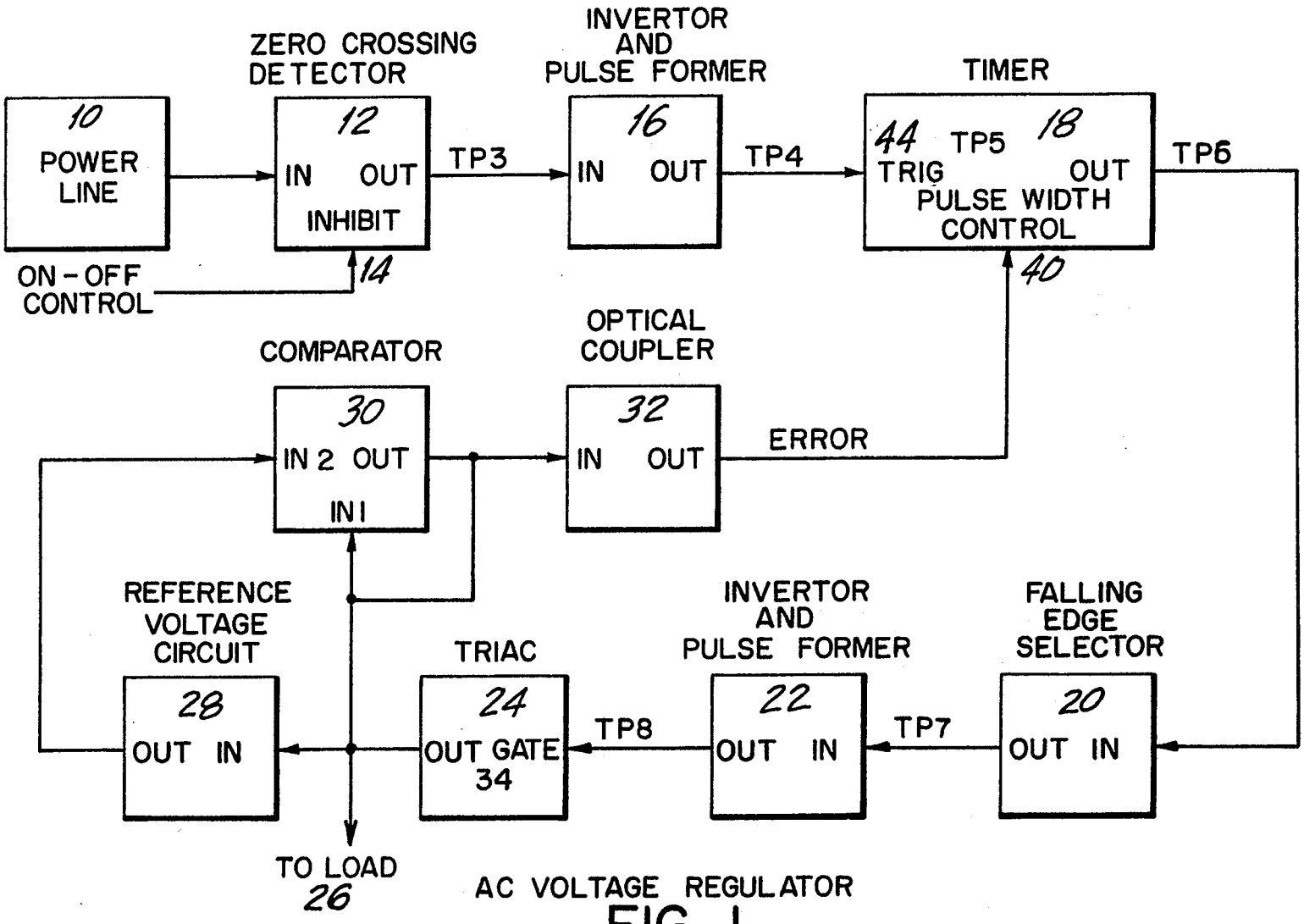
FIG. 1 is a block diagram of the A.C. voltage regulator of the present invention.

Reference is now made to FIGS. 1 and 2 which show the present invention in its preferred embodiment. As shown in FIG. 1, an unregulated alternating current (A.C.) power source 10 serves to deliver voltage to a zero crossing detector 12. The A.C. power source 10 is normally from an electrical wall socket but may also take the form of a power generator or any other source of A.C. power.

Figures 2A, 2B, 2C, 2D, 2E, 2F, 2G:
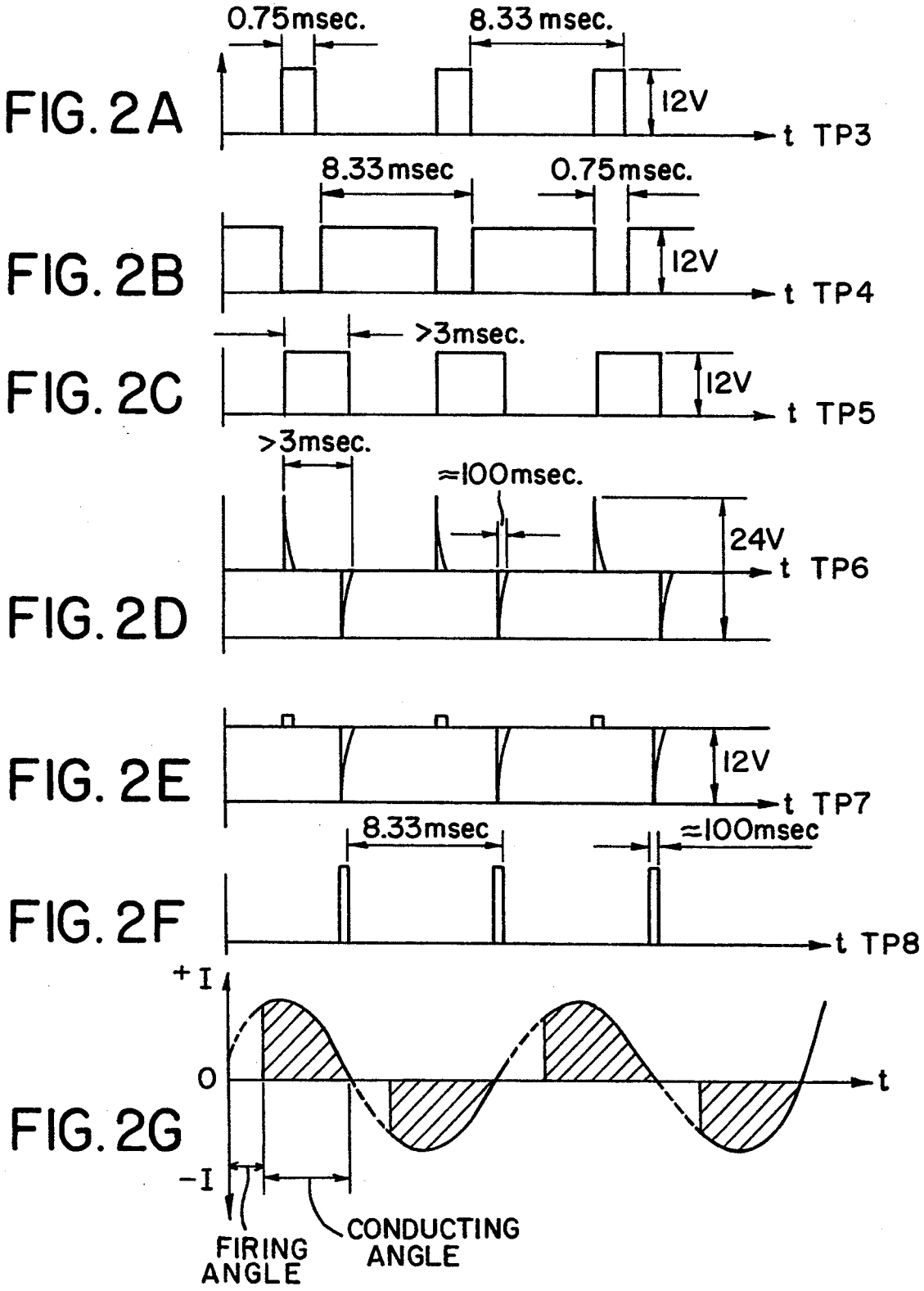
FIGS. 2A–2G are time diagrams of waveforms produced at various points in the circuit of FIG. 1.

The zero crossing detector 12 produces a positive zero crossing detection pulse when the A.C. signal crosses a zero point during its normal sinusoidal waveform. The signal produced by the zero crossing detector 12 is shown in FIG. 2A. This graph shows a 12 volt pulse having a pulse width of 0.75 milliseconds. The pulse is produced every time the A.C. signal crosses the zero point. In the instance described in FIG. 2A a pulse of 0.75 milliseconds duration is produced every 8.33 milliseconds. The zero crossing detector 12 also has an inhibit terminal 14. The inhibit terminal 14 is used to turn the zero crossing detector 12 on or off. When no voltage is received at the inhibit terminal 14, the zero crossing detector 12 is operational and produces the zero crossing detection pulses as shown in FIG. 2A. When a voltage is received at the inhibit terminal 14, the zero crossing detector 12 is disabled and no output pulses are produced. The inhibit terminal 14 acts as a very low current rated switch and provides control over the turning on and off of the high current output produced by the triac as will be discussed later.

Connected to receive the zero crossing detection pulse is a first inverter and pulse former circuit 16. The first inverter and pulse former circuit 16 forms a pulse as shown in FIG. 2B. The effect of the inverter and pulse former circuit 16 can be seen when comparing FIGS. 2A and 2B. The first inverter and pulse former circuit 16 generates a pulse of a certain voltage indicated as 12 volts, when the zero crossing detection pulse is zero, and generates a zero voltage signal when the zero crossing detector 12 produces a pulse of a certain magnitude. The period of the pulse, however, remains constant.

Coupled to receive the output of the first inverter and pulse former circuit 16 is a timer circuit 18. The pulse from the first inverter and pulse former circuit 16 triggers the timer circuit 18 to produce a timing signal having a certain pulse width. The timing signal produced by the timer circuit 18 is shown in FIG. 2C. It can be seen from FIG. 2C that the timer circuit 18 generates a timing signal of a certain duration, in this case a pulse having a pulse width greater than 3 milliseconds. The signal begins on the falling edge of the trigger pulse received from the first inverter and pulse former circuit 16. The end of the timing signal is controlled by the error signal, as will hereinafter be explained. The timer circuit 18 then takes the timing signal and outputs a positive spike pulse on the rising edge of the timing signal and a negative spike pulse on the falling edge of the timing signal, the output pulses as shown in FIG. 2D are thus produced.

The output of the timer circuit 18 is then received by a falling edge selector circuit 20. The falling edge selector circuit 20 produces the waveform shown in FIG. 2E. This waveform consists of the negative spike pulses output by the timer circuit 18 wherein the positive pulses output by the timer circuit 18 is almost entirely filtered out. The negative spike pulses time position is dependent on the error signal, as will hereinafter be explained.

The negative spike pulses produced by the falling edge selector circuit 20 is then delivered to a second inverter and pulse former circuit 22. The second inverter and pulse former circuit 22 inverts the negative spike pulses produced by the falling edge selector 20, producing positive gating pulses having a small pulse width. The gating pulses produced by the second inverter and pulse former circuit 22 are shown in FIG. 2F. These gating pulses are each shown as having a pulse width of approximately 100 microseconds and must be of a magnitude sufficient to gate the triac 24 into a conducting state.

The gating pulses produced by the second inverter and pulse former circuit 22 is then delivered to the gate input 34 of the triac 24, causing the triac 24 to turn to conducting mode. It is understood that the input of voltage is across the main terminals of the triac. When the triac 24 conducts, its output signal is delivered to four separate components. These components are the load 26, a reference voltage circuit 28, a comparator circuit 30 and an optical coupler 32. An example of the triac output is shown in FIG. 2G.

Although one terminal of the triac 24 is grounded, the output of the triac 24, the voltage on the load, is inherently distorted and acts as a non-grounded voltage. The load is also not grounded. A grounded reference voltage circuit, thus, cannot be used to produce a reference voltage for comparison with a triac output signal. Comparing the triac output with a grounded reference voltage will not produce an accurate result. For this reason, the triac output signal must be used as a regulating input to the reference voltage circuit 28 in order to produce a nongrounded reference voltage.

The output of the triac 24 is passed to the reference voltage circuit 28. The reference voltage circuit 28 then produces a stable RMS reference voltage from this output signal and delivers the reference voltage to the comparator circuit 30. The triac output is also input to the comparator circuit 30.

The optical coupler 32 is connected between the output of the triac 24 and the output of the comparator circuit 30. A first terminal of the optical coupler 32 is connected to the triac output terminal and a second terminal of the optical coupler 32 is connected to the output of the comparator signal. The comparator circuit 30 produces an output comparison signal. This signal is a comparison of the triac output signal and the stable RMS reference voltage signal. Because the voltages of the triac output signal and the comparison signal are different, a potential difference exists between the first and second terminals of the optical coupler 32. The optical coupler 32 is responsive to current flowing between the triac output and the comparator output caused by the potential difference. The optical coupler 32, based on this current, sends an error signal to a pulse width control terminal 40 in the timer circuit 18. The error signal delivered to the timer circuit 18 causes the timer circuit 18 to alter the pulse width of its timing signal. By signal controlling the output pulse width of the timing signal by the error signal, the point in time at which the negative spike pulses are generated as shown in FIG. 2D is changed, which also changes the timing of the gating pulse. This will thus change the firing angle of the triac 24. This causes the triac output to be changed. When the triac output changes the voltage delivered to the load also changes. This changing of the firing angle of the triac 24 regulates the voltage delivered to the load to keep the voltage as constant as possible with respect to fluctuations in the input voltage. The timer circuit 18 only alters the pulse width of its timing signal when the potential difference sensed by the optical coupler 32 between the triac output and the comparator output indicates that the triac output has deviated from the RMS reference voltage desired.

The triac output voltage is constantly monitored by the optical coupler 32. The optical coupler 32 thus continually delivers an error signal to the timer circuit 18 to constantly correct the pulse width of the timing signal. The error signal, being dependent on the deviation of the output voltage from the stable RMS reference voltage, thus adjusts the pulse width of the timing signal so that the output voltage remains substantially equal to the stable RMS reference voltage. By constantly monitoring the output voltage, any slight deviation of the output voltage from the stable RMS reference voltage can be detected and the pulse width of the timing signal can be altered to change the firing angle of the triac. Changing the firing angle of the triac will cause the output voltage to change and thus obtain the desired value, being substantially equal to the stable RMS reference voltage. The continual monitoring of the output voltage thus allows only minimal deviation from the stable RMS reference voltage before the output voltage is corrected.

The inhibit terminal 14 in the zero crossing detector 12 can disable firing of the triac and thus operation of the entire voltage regulator without completely turning the device off. This is done by prohibiting the production of a zero crossing detection pulse. When no zero crossing detection pulse is generated, the timer circuit 18 is not triggered and no pulse is delivered to gate the triac 24 into conducting. If no gating pulse is received at the gate of the triac 24, it will not conduct and thus will not deliver an output voltage to the load 26. The high current output of the triac 24 is thus disabled by a very low current rated switch in the zero crossing detector 12.

The A.C. voltage regulator of the present invention will now be described in even further detail with respect to FIG. 3. As can be seen from this figure, the zero crossing detector 12 receives its voltage from a power line or voltage source 10. The zero crossing detector 12 also includes an inhibit terminal 14 which acts as previously described to control on/off of the entire output. The waveform produced by the zero crossing detector 12 is then delivered to the first inverter and pulse former 16. The first inverter and pulse former 16 is in the form of a NAND gate 42. This waveform is delivered to both inputs of the NAND gate 42 which are also tied to ground. The NAND gate 42 also includes a control input tied to a voltage source. The NAND gate 42 inverts this waveform producing a waveform having a measurable output voltage at a point in time when a zero input voltage exists and a zero output voltage at a point in time when a measurable input voltage exists.

This inverted voltage is now delivered to the trigger input 44 of the timer circuit 18. The timer circuit 18 produces a timing signal based upon both the voltage and the error signals received. An RC circuit 46 is connected to the output of the timer circuit 18. The RC circuit 46 produces a positive spike pulse on the rising edge of the timing signal and a negative spike pulse on the falling edge of the timing signal. The positive spike pulse and the negative spike pulse are separated by a distance equal to pulse width of the timing signal.

The spike pulse signal is then filtered in the falling edge selector 20 to allow the negative spike pulses to pass through. The circuit diagram of FIG. 3 illustrates this falling edge selector as a diode 48. Due to the polarity of the diode 48 the negative spike pulses are allowed to pass through in their entirety and the positive spike pulses are almost entirely filtered out.

The negative spike pulses are then delivered to a second NAND gate 50 which acts as the second inverter and pulse former 22. This inverter and pulse former 22 acts to invert the negative spike pulses producing positive pulses of a short duration. The input terminals of the second NAND gate 50 are tied together to receive the negative spike pulses from the falling edge selector 20. These terminals are also tied to a voltage source. When the negative spike pulses are delivered to the second NAND gate 50, the second NAND gate 50 outputs a voltage for the duration of the spike pulse. At all other times no signal is allowed to pass through the second NAND gate 50.

The positive pulses are then delivered to the gate terminal 34 of the triac 24 which causes the triac 24 to conduct. The output voltage is thus produced at the output terminal 54 of the triac 24. The triac 24 delivers the output voltage directly to four separate components. These components are the load 26, the reference voltage circuit 28, the comparator circuit 30 and the optical coupler 32. Voltage delivered to the reference voltage circuit 28 passes through a first voltage rectifier 36 and into two reference voltage circuits 56, 58. Each reference voltage circuit 56, 58 produces a reference voltage which is delivered to a negative terminal of a first and second comparator 60,62, respectively, in the comparator circuit 30.

The output voltage delivered to the comparator circuit 30 from the triac 24 passes through both a second voltage rectifier 38 and a potentiometer 64, and is input to a positive terminal of the first comparator 60. The second comparator 62 receives, as input to its positive terminal, a feedback from its output. The outputs of the first and second comparators 60, 62 are tied together. The output of the triac 24 is also delivered to drive the load 26.

Coupled between the output of the comparator circuit 30 and the first rectifier 36 is the optical coupler circuit 32. Current is caused to pass between the first voltage rectifier 36 and the comparator circuit 30 based upon the existence of a potential difference between these two distinct points. The optical coupler circuit 32 continuously senses this current and delivers an error signal, based on the magnitude of this current, to the pulse width control terminal 40 of the timer circuit 18. The error signal delivered to the timer circuit 18 changes based upon changes in the magnitude of the current. Based on this signal, the timer circuit 18 will alter the pulse width of the timing signal. The pulse width of the timing signal affects the firing of the triac 24, by determining whether the triac 24 will fire earlier or later in the input voltage cycle. If the pulse width is diminished, the triac 24 will be gated to fire earlier in the cycle and if the pulse width is enlarged, the triac 24 will be gated to fire later in the cycle. The time at which the triac 24 fires determines the voltage delivered to the load 26. The constant monitoring of the triac output voltage causes the firing angle of the triac to change and produce an output across the load 26 which is substantially equal to the stable RMS reference voltage. Furthermore, based upon the delay time of the circuit components, the cycle of the voltage through the triac 24 will be delayed from the input voltage cycle.

Figure 3:
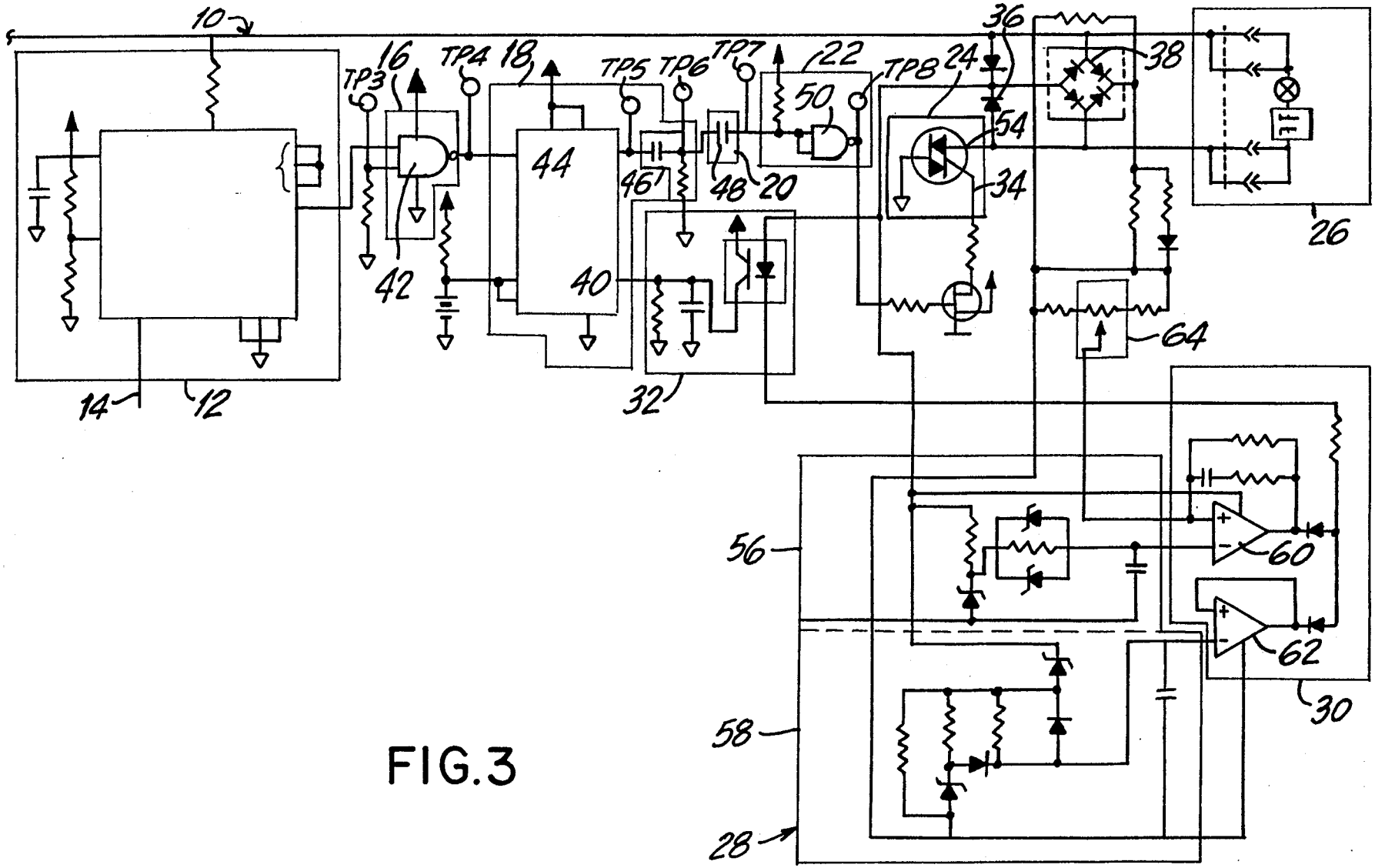
FIG. 3 is a schematic diagram of the present invention.

The schematic diagram shown in FIG. 3 illustrates one possible embodiment of the components used to produce the voltage regulator of the present invention. It is to be understood that the components mentioned may be replaced by other components which can produce similar results.

This voltage regulator circuit will produce an output voltage across the load 26 which should not vary more than plus or minus 2 percent based upon an input voltage which may vary plus or minus 15 percent. It is also to be understood that this voltage regulator can be adapted to produce a stable RMS output voltage for any desired voltage. The output voltage is controlled by adjusting the potentiometer, which provides the input voltage to the positive terminal of the comparator, and adapting the reference voltage circuitry to produce a reference voltage of the desired value. The circuit shown in FIG. 3 is adapted to produce a stable RMS output voltage of 12 volts. This voltage regulator can thus be used to drive any load device which requires a stable RMS voltage, no matter what the magnitude of the input voltage.

There has been disclosed heretofore the best embodiment of the invention presently contemplated. However, it is to be understood that various changes and modifications may be made thereto without departing from the spirit and scope of the invention.

We claim:

1. A voltage regulator for producing a stable RMS output signal from a fluctuating alternating current input signal, comprising:

a timer receiving the input signal and producing a timing signal having a certain pulse width;

a triac controlled by the pulse width of the timing signal and delivering an output signal to a load;

a reference voltage circuit receiving the output signal from the triac and producing a reference signal;

a comparator circuit receiving the output signal and the reference signal and producing therefrom a comparison signal; and a coupling circuit receiving the output signal and the comparison signal and producing an error signal, said error signal being coupled to the timer, whereby the pulse width of the timing signal is a function of receipt of the error signal by the timer thus changing the control of the triac and the output signal produced thereby.

2. The voltage regulator as claimed in claim 1, further comprising a zero crossing detector coupled to receive the input signal and generating a zero crossing signal each time the input signal crosses a zero voltage point, and the timer comprises a trigger terminal for receiving the zero crossing signal and commencing the timing signal each time the zero crossing signal is received.

3. The voltage regulator as claimed in claim 2, wherein the zero crossing detector includes an inhibit terminal for disabling the generation of the zero crossing signal in the zero crossing detector upon receipt of a signal at the inhibit terminal, wherein the timer is thereby not triggered to produce the timing signal and the triac is thereby not gated to conduct.

4. The voltage regulator as claimed in claim 1, further comprising:

a falling edge selector circuit coupled to receive the timing signal, for generating a negative spike pulse on a falling edge of the timing signal; and an inverter and pulse former, coupled to receive the negative spike pulse, for inverting the negative spike pulse and delivering the inverted pulse to the triac, causing the triac to conduct.

5. The voltage regulator as claimed in claim 1, wherein the comparator circuit comprises first and second comparators, the first comparator being coupled to receive the output signal in a positive terminal and the reference signal in a negative terminal, and the second comparator being coupled to receive the reference signal in a negative terminal, and a feedback of an output of the second comparator in a positive terminal, wherein both outputs of the first and second comparators are tied together and to the coupling circuit.

6. The voltage regulator as claimed in claim 1, further comprising a rectifier coupled between the triac output and both the reference voltage circuit and the coupling circuit.

7. A voltage regulator as claimed in claim 1, wherein the coupling circuit further includes means for sensing a potential difference between the output signal and the comparison signal, wherein the error signal produced is based on the sensed potential difference.

8. The voltage regulator as claimed in claim 1, wherein the triac includes a gate terminal for receiving the timing signal; and conducting means, activated upon receipt of the timing signal at the gate terminal, for delivering the output signal to the load.

* * * * *